US011150583B2

(12) United States Patent
Hirose et al.

(10) Patent No.: US 11,150,583 B2
(45) Date of Patent: Oct. 19, 2021

(54) BELT DEVICE AND IMAGE FORMING APPARATUS INCORPORATING SAME

(71) Applicant: Ricoh Company, Ltd., Tokyo (JP)

(72) Inventors: Fumihiro Hirose, Kanagawa (JP); Masateru Ujiie, Kanagawa (JP); Akiyasu Amita, Kanagawa (JP); Tetsuo Tokuda, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/011,590

(22) Filed: Sep. 3, 2020

(65) Prior Publication Data

US 2021/0096488 A1 Apr. 1, 2021

(30) Foreign Application Priority Data

Sep. 27, 2019 (JP) ..... 2019-176881
Sep. 27, 2019 (JP) ..... JP2019-176876

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01)

(58) Field of Classification Search
CPC ..... G03G 15/2017; G03G 15/2032; G03G 15/2035; G03G 15/2053; G03G 15/1615; G03G 2215/00139
See application file for complete search history.

(56) References Cited

U.S. PATENT DOCUMENTS

2002/0136562 A1* 9/2002 Hiroki ..... G03G 15/2064 399/69
2005/0281594 A1 12/2005 Kuma et al.
2016/0306304 A1 10/2016 Hemmi et al.
2016/0306311 A1 10/2016 Ono et al.
2016/0363898 A1 12/2016 Ujiie
2017/0010576 A1* 1/2017 Takagi ..... G03G 21/186
2017/0090368 A1 3/2017 Ujiie et al.
2017/0102652 A1 4/2017 Imada et al.
2017/0131666 A1 5/2017 Sugiyama et al.
2017/0146933 A1 5/2017 Yamano et al.
2017/0269522 A1 9/2017 Kubota et al.
2017/0269524 A1 9/2017 Yamaji et al.
2017/0269525 A1 9/2017 Okamoto et al.
2017/0269526 A1 9/2017 Yuasa et al.
(Continued)

FOREIGN PATENT DOCUMENTS

JP 5-083770 11/1993
JP 8-069143 3/1996
(Continued)

*Primary Examiner* — Thomas S Giampaolo, II
(74) *Attorney, Agent, or Firm* — Xsensus LLP

(57) ABSTRACT

A belt device includes an endless belt, a plurality of support rotators configured to support the endless belt, and a support configured to support shaft portions of the plurality of support rotators. The support has an attaching and detaching path through which the shaft portions of the plurality of support rotators pass in a direction orthogonal to an axial direction of at least one of the plurality of support rotators when the shaft portions of the plurality of support rotators are detached from the support.

11 Claims, 8 Drawing Sheets

(56) References Cited

U.S. PATENT DOCUMENTS

| | | | |
|---|---|---|---|
| 2017/0357197 | A1 | 12/2017 | Okamoto et al. |
| 2017/0357198 | A1 | 12/2017 | Namekata et al. |
| 2018/0081309 | A1 | 3/2018 | Hirose et al. |
| 2018/0088502 | A1 | 3/2018 | Sugiyama et al. |
| 2018/0299809 | A1 | 10/2018 | Saitoh et al. |
| 2019/0011864 | A1 | 1/2019 | Kawata et al. |
| 2019/0018348 | A1 | 1/2019 | Watanabe et al. |
| 2019/0018351 | A1 | 1/2019 | Hirose et al. |

FOREIGN PATENT DOCUMENTS

| | | |
|---|---|---|
| JP | 2000-075708 | 3/2000 |
| JP | 2006-003735 | 1/2006 |
| JP | 2006-133359 | 5/2006 |
| JP | 2009-271178 | 11/2009 |
| JP | 2013-068660 | 4/2013 |
| JP | 2015-068907 | 4/2015 |
| JP | 2017-207608 | 11/2017 |
| JP | 2017-227789 | 12/2017 |

* cited by examiner

BELT DEVICE AND IMAGE FORMING APPARATUS INCORPORATING SAME

CROSS-REFERENCE TO RELATED APPLICATIONS

This patent application is based on and claims priority pursuant to 35 U.S.C. § 119 to Japanese Patent Applications No. 2019-176876 filed on Sep. 27, 2019 and No. 2019-176881 filed on Sep. 27, 2019 in the Japan Patent Office, the entire disclosures of which are hereby incorporated by reference herein.

BACKGROUND

Technical Field

Embodiments of the present disclosure generally relate to a belt device and an image forming apparatus incorporating the belt device.

Background Art

One type of belt device includes an endless belt, a plurality of support rotators that support the endless belt, and a support that detachably supports shaft portions of the support rotators.

SUMMARY

This specification describes a belt device that includes an endless belt, a plurality of support rotators configured to support the endless belt, and a support configured to support shaft portions of the plurality of support rotators. The support has an attaching and detaching path through which the shaft portions of the plurality of support rotators pass in a direction orthogonal to an axial direction of at least one of the plurality of support rotators when the shaft portions of the plurality of support rotators are detached from the support.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
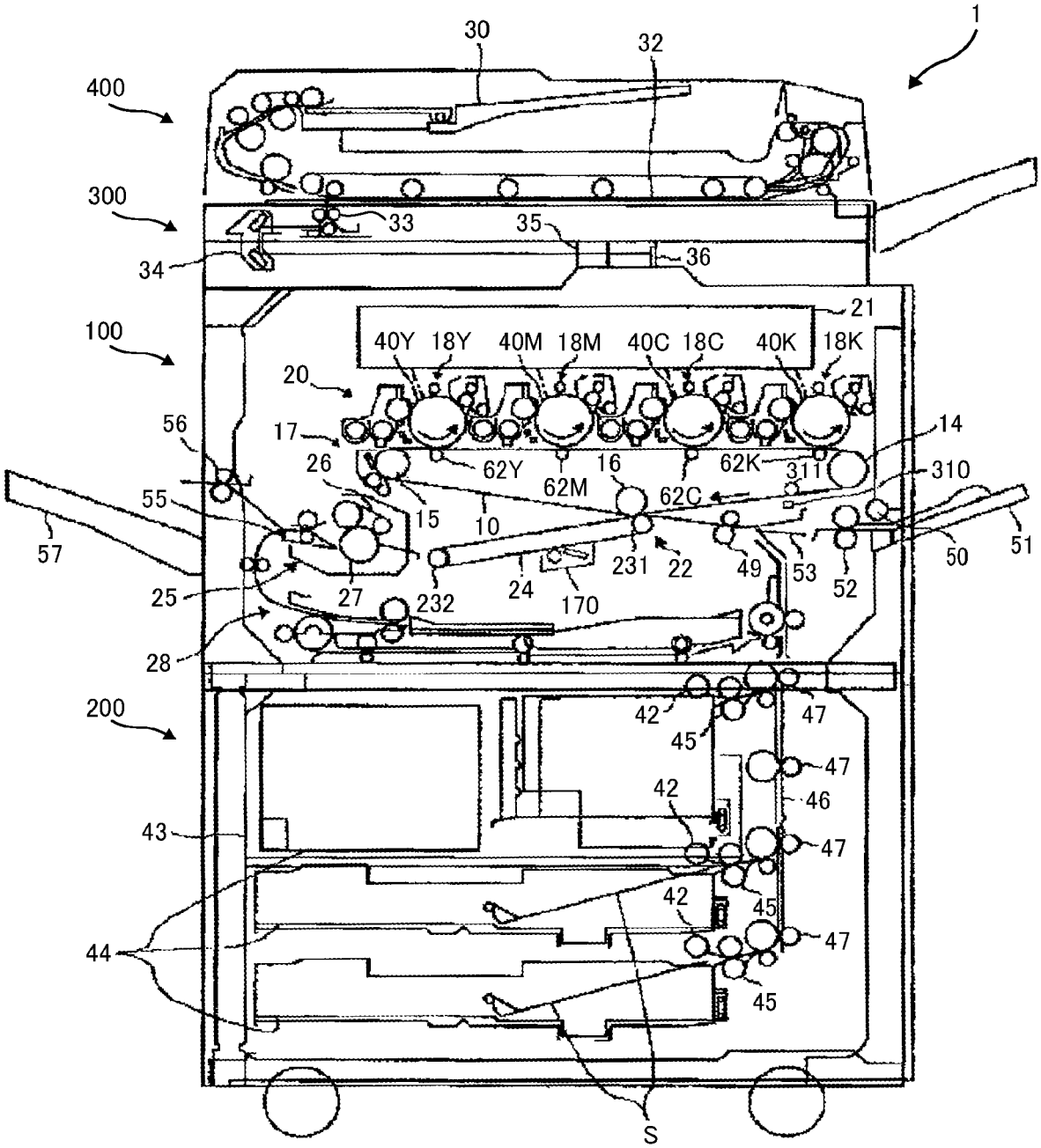
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

Embodiments of the present disclosure are described in detail with reference to drawings. Identical reference numerals are assigned to identical components or equivalents and a description of those components is simplified or omitted.

Hereinafter, embodiments of the present disclosure are described with reference to the drawings.

FIG. 1 is a schematic view illustrating a configuration of an image forming apparatus according to an embodiment of the present disclosure.

Referring to FIG. 1, an image forming apparatus 1 according to the present embodiment includes an apparatus body 100 that is a printer unit, a sheet feed table 200 serving as a recording medium supply unit on which the apparatus body is placed, and a scanner 300 as an image reading device mounted on the apparatus body 100. In addition, the image forming apparatus 1 according to the present embodiment includes an automatic document feeder (ADF) 400 mounted on the scanner 300.

The apparatus body 100 includes an intermediate transfer belt 10 that serves as an intermediate transferor, which is composed of an endless belt that serves as an image bearer, and the transfer belt 10 is disposed in the center of the apparatus body 100. The intermediate transfer belt 10 is stretched over a first support roller 14, a second support roller 15 and a third support roller 16 serving as three support rotators and rotates clockwise in FIG. 1. On the left of the second support roller 15 of the three support rollers in FIG. 1, an intermediate transfer belt cleaner 17 is disposed. The intermediate transfer belt cleaner 17 removes residual toner on the intermediate transfer belt 10 after image transfer. In addition, a tandem image forming section 20 as a toner image forming device is disposed opposite a surface portion of the intermediate transfer belt 10 stretched taut across the first support roller 14 and second support roller 15 of the three support rollers.

The tandem image forming section 20 includes four image forming units 18Y, 18M, 18C, and 18K corresponding to colors of yellow (Y), magenta (M), cyan (C), and black (K) respectively and being disposed along a rotation direction of the intermediate transfer belt 10 as illustrated in FIG. 1. In the present embodiment, the third support roller 16 is a drive roller. Above the tandem image forming section 20, an exposure device 21 is provided.

A secondary transfer device 22 is disposed opposite the tandem image forming section 20 via the intermediate transfer belt 10. In the secondary transfer device 22, a secondary transfer belt 24 is stretched across two rollers 231 and 232. The secondary transfer belt 24 is an endless belt and serves as a sheet conveyer. The secondary transfer belt 24 is disposed to press against the third support roller 16 via the intermediate transfer belt 10. The secondary transfer device 22 transfers a toner image formed on the intermediate transfer belt 10 to a sheet S that is a recording medium. Additionally, a secondary transfer belt cleaning device 170 may be provided to clean the outer circumferential surface of the secondary transfer belt 24 as illustrated in FIG. 1.

On the left side of the secondary transfer device 22 in FIG. 1, a fixing device is disposed to fix the toner image on the sheet S. The fixing device 25 includes a fixing belt 26 as an endless belt to be heated and a pressure roller 27 pressed against the fixing belt 26.

The secondary transfer device 22 has a sheet conveyance function to convey the sheet S to the fixing device 25 after the toner image is transferred from the intermediate transfer belt 10 onto the sheet S. Below the secondary transfer device 22 and the fixing device 25, a sheet reverse unit 28 is disposed in parallel to the tandem image forming section 20 and reverses the sheet S to print both sides of the sheet S.

When a user makes a copy using the above-described image forming apparatus 1, the user places a document on a document table 30 of the automatic document feeder 400. Alternatively, the user may open the automatic document feeder 400, place the document on an exposure glass 32 of the scanner 300, and close the automatic document feeder 400 to press the document against the exposure glass 32. When the user sets the document on the automatic document feeder 400 and presses a start switch on a control panel, the automatic document feeder 400 conveys the document to the exposure glass 32.

When the user sets the document on the exposure glass 32 and presses the start switch, the scanner 300 is driven immediately to move a first carriage 33 and a second carriage 34. Subsequently, the first carriage 33 directs an optical beam from a light source onto the document, and then the optical beam is reflected from a surface of the document to the second carriage 34. Further, the optical beam reflected from a mirror of the second carriage 34 passes through an imaging forming lens 35 and then enters an image reading sensor 36. Thus, the image reading sensor 36 reads the image on the document to obtain the image data.

In parallel with the reading of the document, a drive motor as a driver rotates the third support roller 16 as the drive roller. The rotations of the third support roller 16 rotate the intermediate transfer belt 10 clockwise in FIG. 1, and the rotations of the intermediate transfer belt 10 rotate the other two support rollers that are driven rollers, that is, the first support roller 14 and the second support roller 15.

The image forming units 18Y, 18M, 18C, and 18K include drum-shaped photoconductors 40Y, 40M, 40C, and 40K serving as image bearers, respectively. In parallel with the reading of the document and the rotation of the intermediate transfer belt 10 described above, the drum-shaped photoconductors 40Y, 40M, 40C, and 40K rotate. A surface of each of photoconductors 40Y, 40M, 40C, and 40K is exposed according to the image data of respective colors of yellow, magenta, cyan, and black to form electrostatic latent images. The electrostatic latent images are developed into yellow, magenta, cyan, and black toner images as visible toner images respectively.

Primary transfer devices 62Y, 62M, 62C, and 62K include primary transfer rollers as primary transferors and are disposed opposite the photoconductors 40Y, 40M, 40C, and 40K via a belt part of the intermediate transfer belt 10 between the first support roller 14 and the second support roller 15. The primary transfer devices 62Y, 62M, 62C, and 62K sequentially transfer the toner images on the photoconductors 40Y, 40M, 40C, and 40K onto the intermediate transfer belt 10 to overlap each other and synthesize the toner images to form a synthesized color toner image on the intermediate transfer belt 10.

In parallel with the above image formation, one of feed rollers 42 in the sheet feed table 200 is selected and rotated to move the sheets S from one of multistage sheet trays 44 provided in a sheet bank 43. The moved sheets S are separated one by one by a separation roller pair 45. The separated sheet S is inserted into a sheet conveyance path 46, conveyed by conveyance rollers 47 to a sheet conveyance path inside the apparatus body 100, and stopped by a registration roller pair 49 when the sheet S contacts the registration roller pair 49. Alternatively, a bypass feed roller 50 rotates to move sheets placed on a bypass feeder 51. The moved sheets are separated by a bypass separation roller 52 one by one. The separated sheet is conveyed to a bypass sheet conveyance path 53 and stopped by the registration roller pair 49 when the sheet contacts the registration roller pair 49.

Timed to coincide with the synthesized color toner image on the intermediate transfer belt 10, the registration roller pair 49 rotates and sends the sheet S to a secondary transfer nip between the intermediate transfer belt 10 and the secondary transfer device 22. The secondary transfer device 22 transfers the color toner image onto the sheet S.

The secondary transfer belt 24 conveys the sheet S bearing the color toner image to the fixing device 25. In the fixing device 25, the fixing belt 26 and the pressure roller 27 apply heat and pressure to the sheet S to fix the color toner image on the sheet S. After the above fixing process, a switching craw 55 directs the sheet S to an ejection roller pair 56. The ejection roller pair 56 ejects the sheet S onto a sheet ejection tray 57 that stacks the sheet S. Alternatively, the switching craw 55 directs the sheet S to the sheet reverse unit 28. The sheet reverse unit 28 reverses the sheet S and guides the sheet S to the secondary transfer nip where another toner image is transferred onto a back side of the sheet S. Thereafter, the ejection roller pair 56 ejects the sheet S onto the sheet ejection tray 57.

The intermediate transfer belt cleaner 17 removes residual toner that remains on the intermediate transfer belt 10 after the secondary transfer of the color toner image from the intermediate transfer belt 10, and the tandem image forming section 20 becomes ready for a next image formation. In general, the registration roller pair 49 is grounded, however, the registration roller pair 49 may be applied with a bias voltage to remove paper dust from the sheet S.

The apparatus body 100 includes a toner adhesion amount sensor 310 that is an optical sensor unit serving as an image density detector to detect a density of the toner image formed on the outer circumferential surface of the intermediate transfer belt 10. The toner adhesion amount sensor 310 works as the image density detector that detects the density of the toner image on the intermediate transfer belt 10 to detect an image density fluctuation by detecting a toner adhesion amount on the intermediate transfer belt 10. The toner adhesion amount sensor 310 is also called a toner image detection sensor or a toner adhesion detection sensor. The toner adhesion amount sensor 310 detects a density of toner image in a test pattern formed on the surface of the intermediate transfer belt 10 to obtain a detection result used in correction control of the image density fluctuation. In addition, as illustrated in FIG. 1, a facing roller 311 may be disposed at a position opposite the toner adhesion amount sensor 310 with the intermediate transfer belt 10 sandwiched in between.

Figure 2:
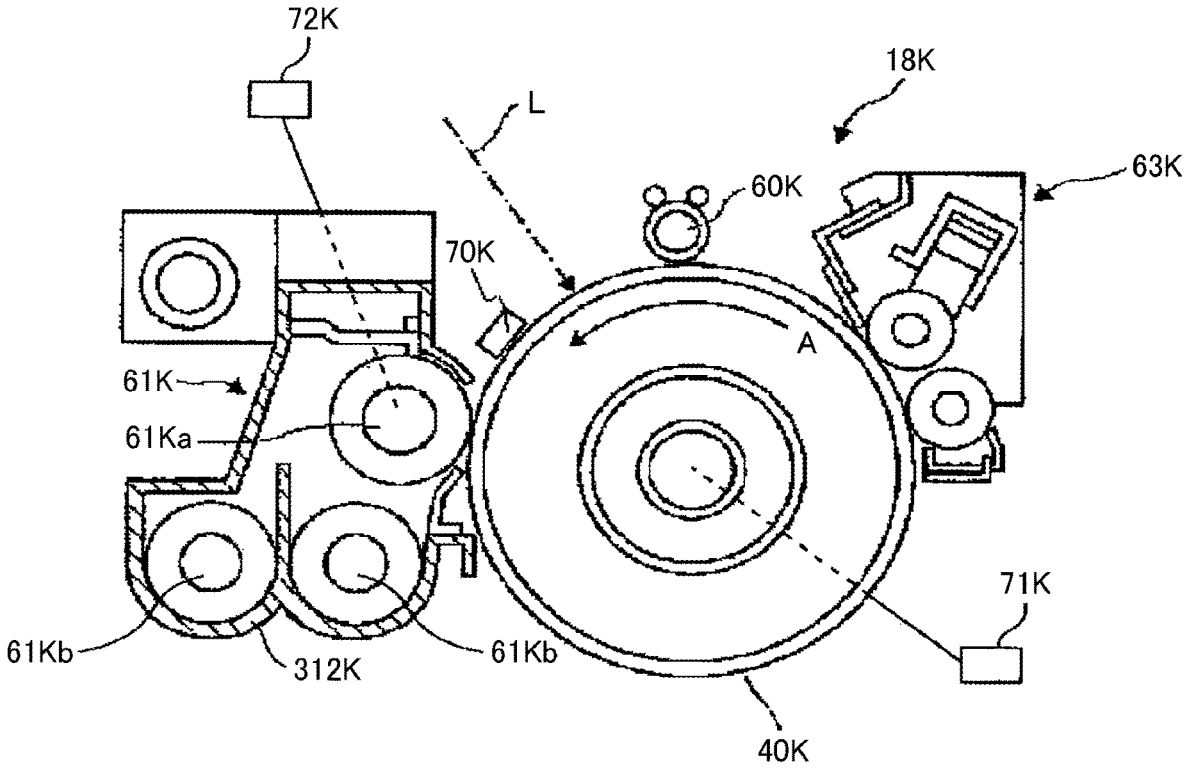
FIG. 2 is an explanatory view illustrating a configuration of an image forming unit in a tandem image forming section of the image forming apparatus of FIG. 1.

FIG. 2 is an explanatory view illustrating a configuration of the image forming unit 18K in the tandem image forming section 20 of the image forming apparatus 1 in FIG. 1.

The image forming unit 18K to form the black toner image is described below. The image forming units 18Y, 18M, and 18C have an identical configuration.

As illustrated in FIG. 2, the image forming unit 18K includes, for example, a charging device 60K, a potential sensor 70K, a developing device 61K, a photoconductor cleaner 63K, and a discharger around the drum-shaped photoconductor 40K.

The photoconductor 40K is driven by a drive motor as an image bearer driver to rotate in a rotation direction A during image formation. The surface of the photoconductor 40K is uniformly charged by the charging device 60K and is exposed by exposure light L from the exposure device 21 controlled based on color image signals generated according to the image data created by the scanner 300 that reads the image on the document. Thus, an electrostatic latent image is formed on the surface of the photoconductor 40K. The color image signals generated according to the image data by the scanner 300 are subjected to imaging processes such as a color conversion process by an image processor and output to the exposure device 21 as image signals for each color of yellow, magenta, cyan, and black. The exposure device 21 converts black image signals from the image processor into optical signals, irradiates and scans the uniformly charged surface of the photoconductor 40K with the exposure light L based on the optical signals to form an electrostatic latent image on the photoconductor 40K.

The developing device 61K includes a developing roller 61Ka as a developer bearer. A developing bias voltage is applied to the developing roller 61Ka to form a developing potential that is a potential difference between the electrostatic latent image on the photoconductor 40K and the developing roller 61Ka. The developing potential transfers the toner on the developing roller 61Ka from the developing roller 61Ka to the electrostatic latent image on the photoconductor 40, and the electrostatic latent image is developed to form the toner image. In addition, the developing device 61K includes a developer conveying screw 61Kb in a developer conveying portion of the developing device 61K and a toner concentration sensor 312K in a bottom portion of the developer conveying portion to detect a concentration (e.g., percent by weight) of toner in the developer.

The black toner image formed on the photoconductor 40K is transferred onto the intermediate transfer belt 10 by the primary transfer device 62K. After the black toner image is transferred, the photoconductor cleaner 63K removes the residual toner from the surface of the photoconductor 40K, and the discharger discharge the surface of the photoconductor 40K. Thus, the photoconductor 40K is ready for the next image formation. Similarly, the image forming units 18Y, 18M, and 18C include charging devices, potential sensors, developing devices, photoconductor cleaners, and dischargers around the drum-shaped photoconductors 40Y, 40M, and 40C, respectively. The image forming units 18Y, 18M, and 18C form yellow, magenta, and cyan toner images on the photoconductors 40Y, 40M, and 40C, respectively. The toner images are primarily transferred onto the intermediate transfer belt 10 such that the yellow, magenta, and cyan toner images are superimposed on the intermediate transfer belt 10.

The exposure device 21 and the charging devices 60Y, 60M, 60C, and 60K in the image forming apparatus 1 described above work as electrostatic latent image writers that form electrostatic latent images on the surfaces of the photoconductors 40Y, 40M, 40C, and 40K. In addition, the exposure device 21, the charging devices 60Y, 60M, 60C, and 60K, and the developing devices 61Y, 61M, 61C, and 61K work as toner image forming devices that form toner images on the surfaces of the photoconductors 40Y, 40M, 40C, and 40K.

The image forming apparatus 1 according to the present embodiment includes photointerrupters 71K and 72K. The photointerrupter 71K is a rotational position detector that detects a rotational position of the photoconductor 40K. The photointerrupter 72K is a rotational position detector that detects a rotational position of the developing roller 61Ka. The photointerrupter 71K optically detects the rotational position of the photoconductor 40K as a rotating body, and the photointerrupter 72K optically detects the rotational position of the developing roller 61Ka as another rotating body. For example, each of the photointerrupters 71K and 72K includes a light-emitting element and a light-receiving element facing each other. A filler to detect the rotational position is disposed on a rotating part of the rotating body. When the filler passes through a space between the light-emitting element and the light-receiving element, light from the light-emitting element is cut out by the filler. Thus, a rotational position of the rotating body is identified. The filler to detect the rotational position rotates together with the photoconductor 40K. The filler includes a notch around a circumference of the filler. Therefore, light passes through the notch and reaches the light-receiving element in every turn of the photoconductor 40K. Thus, the rotational position of the photoconductor 40K is identified. The rotational position detector that detects the rotational position of the rotating body such as the photoconductor 40K and the developing roller 61Ka may use devices other than the photointerrupter.

Figure 3:
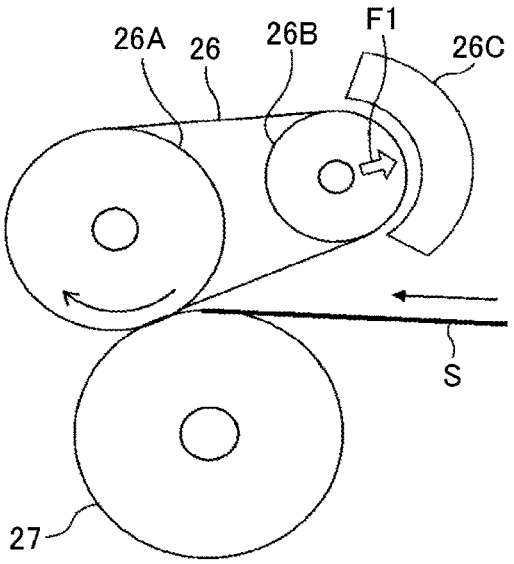
FIG. 3 is an explanatory view illustrating a configuration of a fixing device in the image forming apparatus of FIG. 1.

FIG. 3 is an explanatory view illustrating a configuration of the fixing device that serves as a belt device in the image forming apparatus 1 according to the present embodiment.

The fixing device 25 according to the present embodiment includes the fixing belt 26 extended between a fixing roller 26A that is a drive support rotator and a heating roller 26B that is a driven support rotator and the pressure roller 27 pressed against the fixing belt 26. In addition, the fixing device 25 according to the present embodiment includes an induction heating device 26C that heats the heating roller 26B using a non-contact heating method such as an induction heating method (IH method). The induction heating device 26C includes an exciting coil that generates a magnetic alternating field to cause induction heat generation in a heat generation layer of the heating roller 26B.

In the fixing device 25 according to the present embodiment, the heating roller 26B functions as a tension roller and is pressed in a direction of arrow F1 in FIG. 3. In the fixing device 25 according to the present embodiment, the induction heating device 26C heats the heating roller 26B to heat the fixing belt 26, and, when the sheet S passes through a fixing nip between the heated fixing belt 26 and the pressure roller 27, the heat and pressure fixes the toner image onto the sheet S.

The fixing device 25 according to the present embodiment is removably installed in the apparatus body 100 of the image forming apparatus 1. A driving force to drive the fixing roller 26A is transmitted from a driving source disposed in the apparatus body 100 of the image forming apparatus 1 by a driving force transmission assembly.

Figure 4:
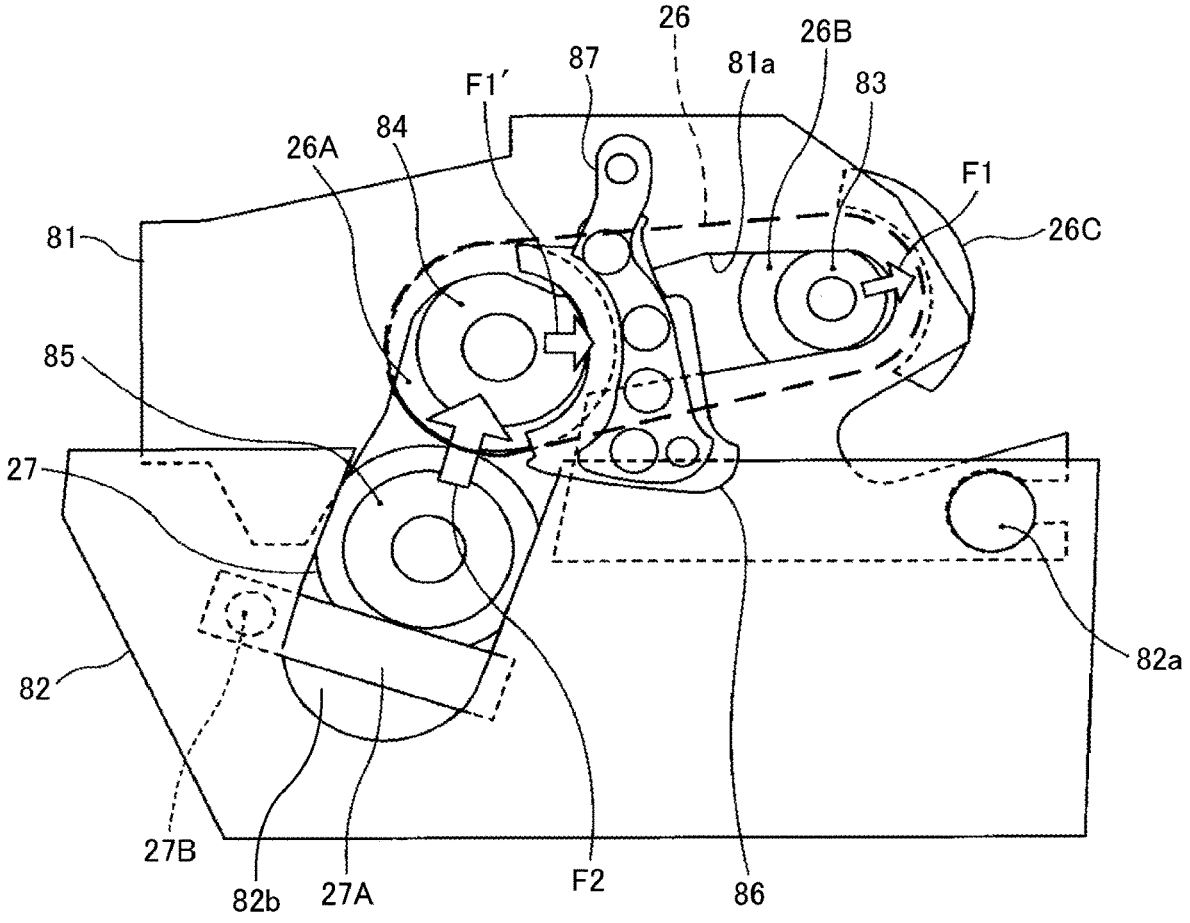
FIG. 4 is a side view of a configuration of a support mechanism that supports, for example, a fixing roller, a heating roller, and a pressure roller in a fixing device, according to an embodiment of the present disclosure.

FIG. 4 is a side view of a support mechanism that supports, for example, the fixing roller 26A, the heating roller 26B, and the pressure roller 27 of the fixing device 25, according to the present embodiment.

Figure 5:
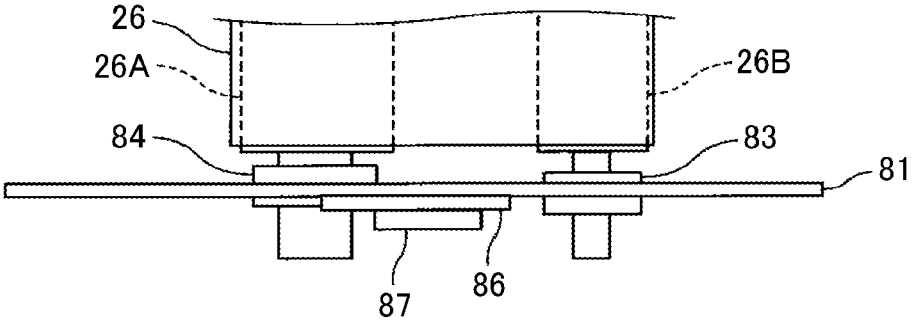
FIG. 5 is a top view of a fixing frame that supports shaft portions of the fixing roller and the heating roller as well as a second fixing frame and a sub-face plate that are attached to the fixing frame, according to the present embodiment.

FIG. 5 is a top view of a fixing frame 81 that supports shaft portions of the fixing roller 26A and the heating roller 26B as well as a second fixing frame 86 and a sub-face plate 87 that are attached to the fixing frame 81, according to the present embodiment.

The fixing device 25 according to the present embodiment includes a pair of fixing frames 81 and pressure frames 82, at both ends of the fixing roller 26A, the heating roller 26B, and the pressure roller 27, as side plates of the fixing device 25, in the axial directions of these rollers. A configuration of the fixing frame 81 and the pressure frame 82 at one end in the axial directions is described below. In the present embodiment, the fixing frame 81 and the pressure frame 82 at the other end in the axial directions have the same configuration. Accordingly, the description of the configuration at the other end in the axial directions is omitted. The fixing frame 81 as a support supports the shaft portion 84 of the fixing roller 26A and the shaft portion 83 of the heating roller 26B which are support rotators, and the pressure frame 82 as a facing member supports the shaft portion 85 of the pressure roller 27 which is a contact rotator. The shaft portions 83 of the heating roller 26B, the shaft portions 84 of the fixing roller 26A, and the shaft portions 85 of the pressure roller 27 include ball bearings.

A pressure lever 27A is attached to the pressure frame 82 so as to be rotatable around a lever rotation shaft 27B. When the fixing device 25 is used, the pressure lever 27A presses the shaft portion 85 of the pressure roller 27 against the fixing roller 26A so that the pressure roller 27 presses a portion of the fixing belt 26 wound around the fixing roller 26A with a pressing force F2.

Figure 6:
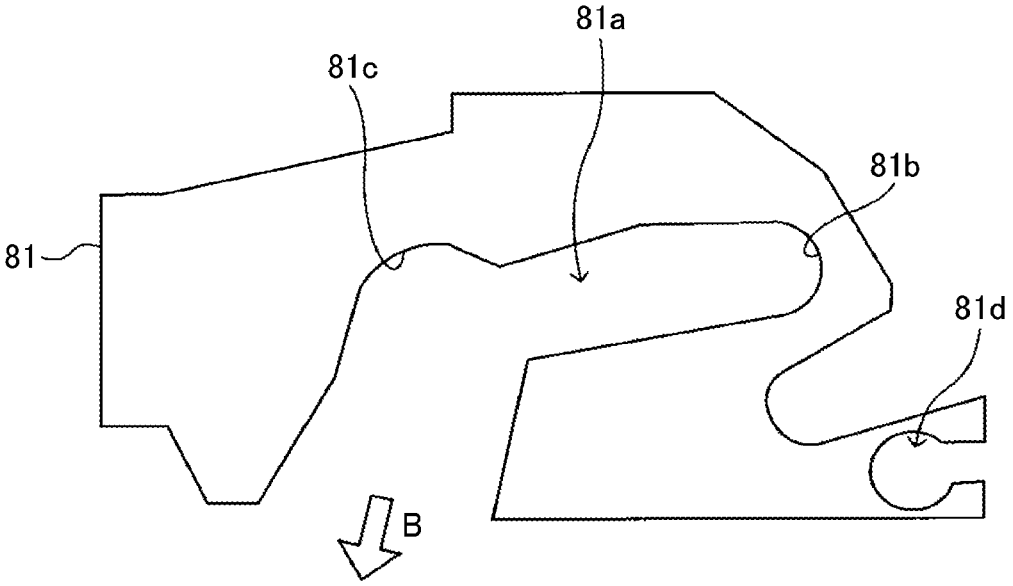
FIG. 6 is a side view of the fixing frame of FIG. 4 that supports the shaft portions of the fixing roller and the heating roller.

FIG. 6 is a side view of the fixing frame 81 that supports the shaft portions 83 and 84 of the fixing roller 26A and the heating roller 26B, according to the present embodiment.

The fixing frame 81 includes an attaching and detaching path 81*a*. Through the attaching and detaching path 81*a*, the shaft portion 84 of the fixing roller 26A and the shaft portion 83 of the heating roller 26B can move in a direction orthogonal to the axial directions. Due to this configuration, the fixing roller 26A and the heating roller 26B that are wrapped with the fixing belt 26 can be attached and detached in the direction orthogonal to the axial directions. As the fixing roller 26A and the heating roller 26B that are wrapped with the fixing belt 26 can be attached and detached as described above, the number of operations can be reduced and the operations can be done easily compared with the operations known in the art in which the fixing roller 26A or the heating roller 26B is pulled out in the axial direction and then the fixing belt 26 is removed.

Figure 7A:
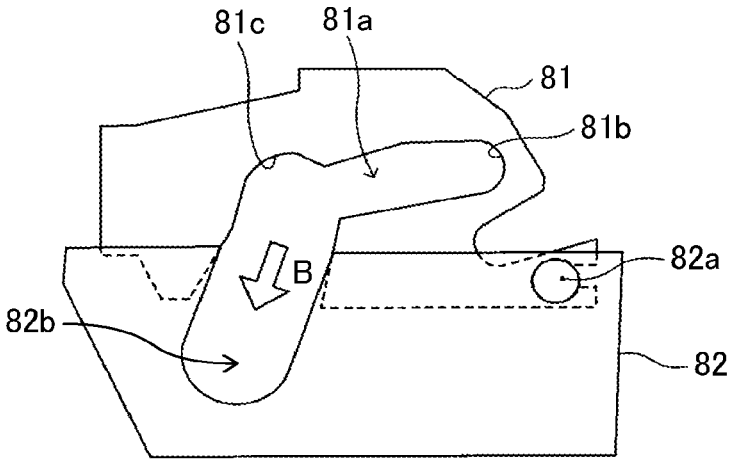
FIG. 7A is a side view of the fixing frame closed by a pressure frame, according to an embodiment of the present disclosure.

The attaching and detaching path 81*a* of the fixing frame 81 is formed by a notch in the fixing frame 81. The shaft portion 83 of the heating roller 26B is disposed at a position near an end 81*b* of the attaching and detaching path 81*a*, and the shaft portion 84 of the fixing roller 26A is disposed in a hollow 81*c* that serves as a positioner formed in the middle of the attaching and detaching path 81*a*. When the fixing roller 26A and the heating roller 26B that are wrapped with the fixing belt 26 are to be detached, the shaft portions 83 and 84 of the fixing roller 26A and the heating roller 26B are to be pulled out in a direction indicated by arrow B as illustrated in FIG. 6 through a gateway of the attaching and detaching path 81*a*. However, in a usage state as illustrated in FIG. 7A, the gateway of the attaching and detaching path 81*a* is closed by the pressure frame 82 that serves as a facing member and the pressure roller 27 supported by the pressure frame 82. In other words, the gateway is in a closed gateway state. For this reason, the fixing roller 26A and the heating roller 26B cannot be detached in such a usage state.

Figure 7B:
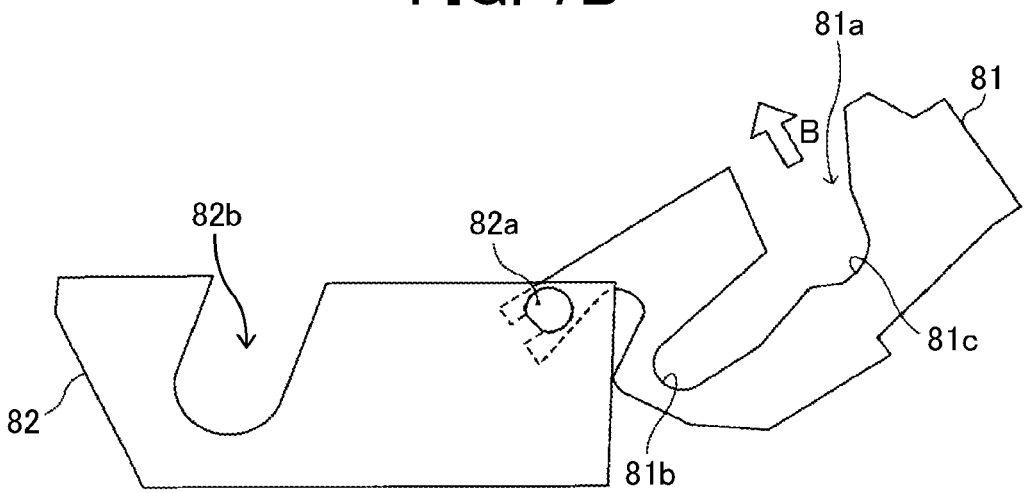
FIG. 7B is a side view of the fixing frame of FIG. 7A opened and released from the pressure frame.

In the present embodiment, a shaft support 81*d* of the fixing frame 81 engages with a rotation shaft 82*a* of the pressure frame 82 to form a pivotable mechanism that enables the fixing frame 81 to pivot around the rotation shaft 82*a* with respect to the pressure frame 82. The above-described configuration can rotate the fixing frame 81 as illustrated in FIG. 7B so that the gateway of the attaching and detaching path 81*a* in the fixing frame 81 directs upper side to open the gateway of the attaching and detaching path 81*a*, which is referred to as an opened gateway state.

Due to the above-described opened gateway state, the shaft portions 83 and 84 of the fixing roller 26A and the heating roller 26B can be pulled out through the gateway of the attaching and detaching path 81*a* in the direction indicated by arrow B, and the fixing roller 26A and the heating roller 26B that are wrapped with the fixing belt 26 can be detached in the direction orthogonal to the axial direction, which is an upper side in FIG. 7A. In addition, the pressure frame 82 has an attaching and detaching path 82*b* to set the shaft portion 85 of the pressure roller 27. The pressure roller 27 can be removed or attached through the attaching and detaching path 82*b*.

At this time, in the present embodiment, the shaft portions 83 and 84 of the fixing roller 26A and the heating roller 26B are removed in the direction orthogonal to the axial direction through the same attaching and detaching path 81*a*. That is, an operation of grasping and pulling out the fixing roller 26A supported near the gateway of the attaching and detaching path 81*a* by the fixing frame 81 pulls out the shaft portion 83 of the heating roller 26B together with the fixing belt 26 from the attaching and detaching path 81*a*. If the shaft portions 83 and 84 of the fixing roller 26A and the heating roller 26B are to be detached in the direction orthogonal to the axial direction through separate attaching and detaching paths, the shaft portions 83 and 84 are to be pulled out through different attaching and detaching paths separately. On the other hand, according to the present embodiment, one operation of pulling out the shaft portion 84 of the fixing roller 26A from the attaching and detaching path pulls out the shaft portion 83 of the heating roller 26B together with the fixing belt 26. That is, the one pulling operation can remove the fixing roller 26A, the heating roller 26B, and the fixing belt 26 supported by the fixing roller 26A and the heating roller 26B at a time, and the work becomes easy.

In the present embodiment, since the heating roller 26B functions as the tension roller as described above, an external force in a direction indicated by arrow F1' in FIG. 4 acts on the fixing roller 26A via the fixing belt 26. In addition, since the pressure roller 27 presses the fixing roller 26A, an external force in a direction indicated by arrow F2 in FIG. 4 also acts on the fixing roller 26A. Firmly positioning the shaft portion 84 of the fixing roller 26A is required so that these external forces do not displace the position of the fixing roller 26A.

However, in the present embodiment, since the attaching and detaching path 81*a* is formed in the fixing frame 81 and the fixing roller 26A and the heating roller 26B that are wrapped with the fixing belt 26 in the direction orthogonal to the axial direction, the shaft portion 84 of the roller 26A is positioned in the middle of the attaching and detaching path 81*a*. In the above-described configuration, since the hollow 81*c* of the fixing frame 81 that contacts and positions the shaft portion 84 of the fixing roller 26A is small, it is difficult for the fixing frame 81 to firmly position the shaft portion 84 of the fixing roller 26A.

Therefore, as illustrated in FIGS. 4 and 5, the fixing device 25 in the present embodiment includes the sub-face plate 87 as an attachment and the second fixing frame 86 as a restraint to position the shaft portion 84 of the fixing roller 26A in addition to the fixing frame 81. The second fixing frame 86 contacts the shaft portion 84 of the fixing roller 26A from the end 81*b* of the attaching and detaching path 81*a*, that is, from the heating roller 26B and positions the shaft portion 84 of the fixing roller 26A. The second fixing frame 86 is screwed to the sub-face plate 87. The sub-face plate 87 is positioned with the fixing frame 81 by a pin or a boss and is fixed to the fixing frame 81 by screwing.

If the second fixing frame 86 is directly fixed to the fixing frame 81, for example, when the fixing roller 26A is replaced, a dimensional error or the like may prevent properly positioning the shaft portion 84 of the replaced fixing roller 26A. To properly position the shaft portion 84 of the replaced fixing roller 26A, the fixing frame 81 needs a long hole or the like to adjust a position of the second fixing frame 86 fixed on the fixing frame 81. The long hole may cause a problem such as reducing the strength of the fixing frame 81.

In the present embodiment, since the sub-face plate 87 is positioned by pins with respect to the fixing frame 81, the sub-face plate 87 can be fixed at the same position of the fixing frame 81 again after the sub-face plate 87 was removed. In addition, the second fixing frame 86 in the present embodiment is set to be able to adjust the position on the sub-face plate 87 and fixed on the fixing frame 81 via the sub-face plate 87. For example, the sub-face plate 87 as the attachment may have a long hole to adjust a position of the second fixing frame 86 as the restraint. While the second fixing frame 86 is pushed to the shaft portion 84 of the fixing roller 26A, a bolt may be inserted to the long hole, and a nut may be attached to the bolt to fix the second frame 86 to the sub-face plate 87. The above-described configuration can suitably position the shaft portion 84 of the fixing roller 26A even after the replacement of the fixing roller 26A without causing the problem such as reducing the strength of the fixing frame 81.

In the above-described configuration, the hollow 81*c* of the fixing frame 81 contacts the shaft portion 84 of the fixing roller 26A and can mainly receive the external force F2 applied from the pressure roller 27 to the shaft portion 84 of the fixing roller 26A, and the second fixing frame 86 can mainly receive the tension force F1' applied to the shaft portion 84 of the fixing roller 26A via the fixing belt 26. As a result, the shaft portion 84 of the fixing roller 26A can be positioned so that these external forces do not displace the position of the fixing roller 26A.

The fixing device 25 according to the present embodiment adopts an induction heating method (IH method) and includes an induction heating device 26C that causes induction heating in the heating roller 26B. To cause appropriate induction heating, it is preferable to keep a distance between the induction heating device 26C and the heating roller 26B constant. On the other hand, the heating roller 26B according to the present embodiment serves as a tension roller as described above and can be displaced in the direction orthogonal to the axial direction. Therefore, preferably, the induction heating device 26C is configured so that the induction heating device 26C can be displaced integrally with the heating roller 26B to follow the displacement of the heating roller 26B.

The induction heating device 26C may be attached to the heating roller 26B not to be separated from each other, but in this case, when the fixing roller 26A and the heating roller 26B that are wrapped with the fixing belt 26 are detached, the induction heating device 26C needs to be detached together with the fixing roller 26A and the heating roller 26B. A work of replacing the fixing belt 26 does not originally need removing the induction heating device 26C. Therefore, the above-described configuration that needs removing the induction heating device 26C together with the fixing belt 26 to replace the fixing belt 26 increases the workload.

Figure 8:
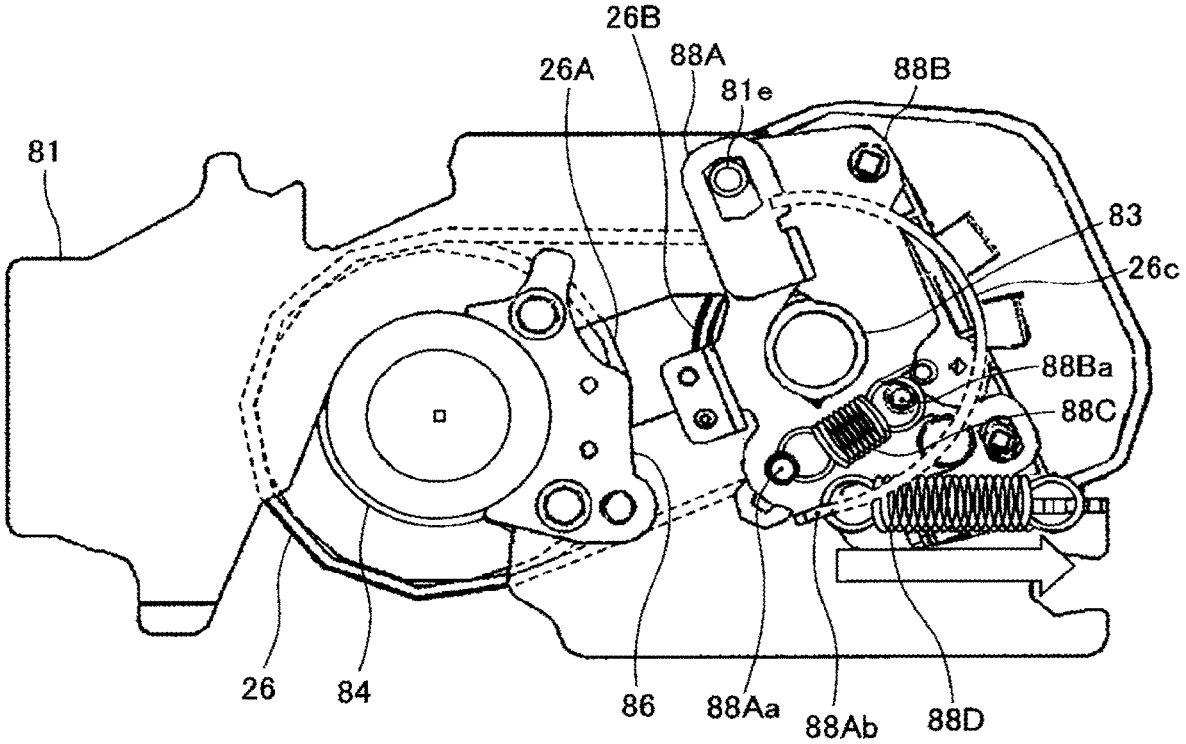
FIG. 8 is a side view of a support mechanism that supports the shaft portions of the heating roller in the fixing device of FIG. 3.

FIG. 8 is a side view of a support mechanism that supports the shaft portion 83 of the heating roller 26B, according to the present embodiment.

In the present embodiment, the shaft portion 83 of the heating roller 26B as a support rotator is sandwiched by two holders, that is, a first sheet metal 88A and a second sheet metal 88B, and the fixing frame 81 as the support supports the first sheet metal 88A and the second sheet metal 88B so that the first sheet metal 88A and the second sheet metal 88B can move in a displacement direction of the heating roller 26B.

Specifically, the first sheet metal 88A and the second sheet metal 88B are assembled to the fixing frame 81 so that the first sheet metal 88A and the second sheet metal 88B can rotate on the same rotation shaft 81*e* provided on the fixing frame 81. More specifically, the first sheet metal 88A and the second sheet metal 88B are supported at positions displaced from each other in the axial direction of the rotation shaft 81*e*. In a sandwich state in which the shaft portion 83 of the heating roller 26B is sandwiched by the first sheet metal 88A and the second sheet metal 88B, the first sheet metal 88A and the second sheet metal 88B that sandwich the shaft portion 83 of the heating roller 26B partially overlap each other when viewed in the axial direction.

The first sheet metal 88A has a fitting boss 88Aa that is attached to one end of a holding spring 88C that is a compression spring, and the second sheet metal 88B has a fitting boss 88Ba that is attached to the other end of the holding spring 88C. The fitting bosses 88Aa and 88Ba are disposed opposite a rotation shaft 81*e* via the shaft portion 83 of the heating roller 26B. In the above-described configuration, a force of the holding spring 88C attached between the fitting bosses 88Aa and 88Ba pushes the first sheet metal 88A and the second sheet metal 88B so that the first sheet metal 88A and the second sheet metal 88B rotate in directions opposite to each other around the rotation shaft 81*e*. As a result, due to the force of the holding spring 88C, the shaft portion 83 of the heating roller 26B can be sandwiched between the first sheet metal 88A and the second sheet metal 88B.

The first sheet metal 88A and the second sheet metal 88B sandwiching the shaft portion 83 of the heating roller 26B are rotatable around a rotation shaft 81*e* on the fixing frame 81. As the first sheet metal 88A and the second sheet metal 88B rotate, the shaft portion 83 of the heating roller 26B can approach to or separate from the fixing roller 26A along the attaching and detaching path 81*a*. In the first sheet metal 88A and the second sheet metal 88B, the first sheet metal 88A is a gateway-side holder positioned closer to the gateway of the attaching and detaching path 81*a* than the shaft portion 83 of the heating roller 26B and has a spring attachment portion 88Ab that is attached to one end of a tension spring 88D that is the compression spring. The other end of the tension spring 88D is attached to a spring attachment portion 81*f* disposed on the fixing frame 81. In the above-described configuration, a force of the tension spring 88D pushes the first sheet metal 88A so that the first sheet metal 88A rotates counterclockwise on the rotation shaft 81*e* with respect to the fixing frame 81 in FIG. 8. As a result, due to the force of the tension spring 88D, the shaft portion 83 of the heating roller 26B is urged via the first sheet metal 88A in the direction away from the fixing roller 26A along the attaching and detaching path 81*a*.

At this time, the shaft portion 84 of the fixing roller 26A supporting the fixing belt 26 together with the heating roller 26B is positioned and fixed by the second fixing frame 86 fixed to the fixing frame 81 via the sub-face plate 87. Therefore, the force of the tension spring 88D acts on the shaft portion 83 of the heating roller 26B via the first sheet metal 88A and applies tension to the fixing belt 26.

A fluctuation in the tension of the fixing belt 26 causes the shaft portion 83 of the heating roller 26B to be displaced in a direction in which the shaft portion 83 approaches the fixing roller 26A or a direction in which the shaft portion 83 is away from the fixing roller 26A along the attaching and detaching path 81*a*. In the present embodiment, the induction heating device 26C is supported by the second sheet metal 88B so that the induction heating device 26C can be displaced integrally with the heating roller 26B following the displacement of the heating roller 26B. That is, the first sheet metal 88A, the second sheet metal 88B, and the shaft portion 83 of the heating roller 26B sandwiched between the second sheet metal 88B and the first sheet metal 88A by the force of the holding spring 88C are configured to rotate as a whole on the rotation shaft 81*e*. Therefore, the displacement of the shaft portion 83 of the heating roller 26B along the attaching and detaching path 81*a* due to the fluctuation in the tension of the fixing belt 26 causes a displacement (rotation) of the second sheet metal 88B and a displacement of the induction heating device 26C integrally supported by the second sheet metal 88B.

Figure 9:
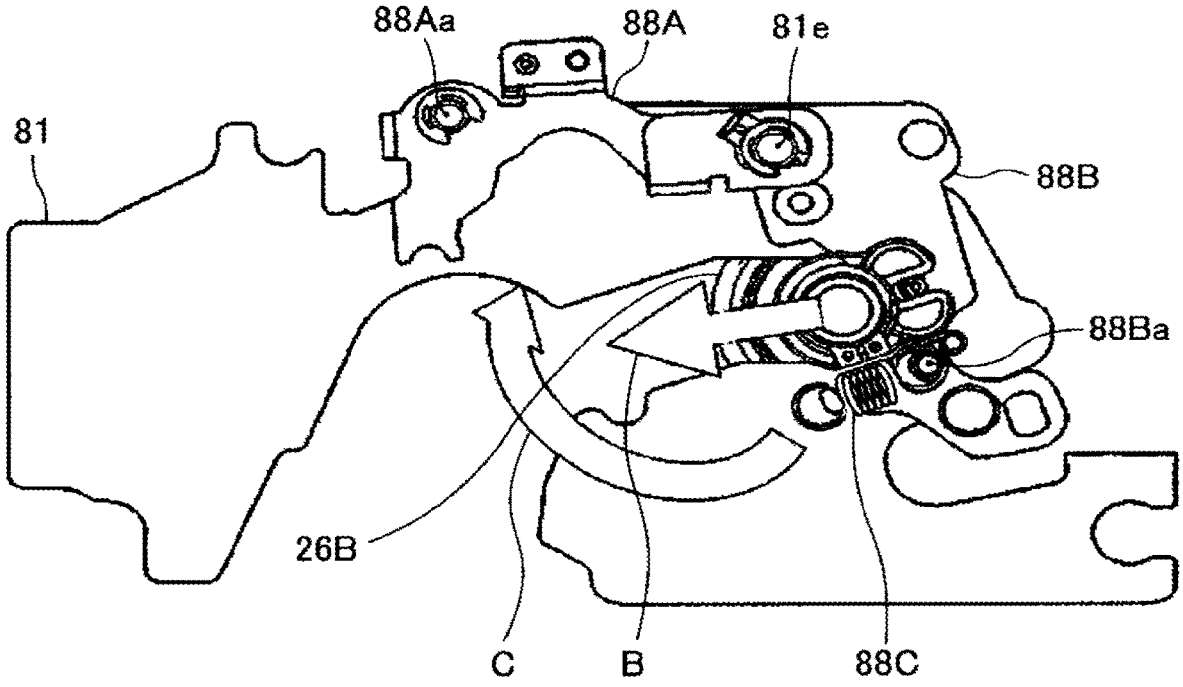
FIG. 9 is a side view of a released state in which a first sheet metal is rotated on a rotation shaft of the fixing frame and a held state of the shaft portion of the heating roller held between the first sheet metal and a second sheet metal is released, according to an embodiment of the present disclosure.

As illustrated in FIG. 9, when the above-described holding spring 88C and the tension spring 88D is removed, the first sheet metal 88A can be rotated on the rotation shaft 81*e* on the fixing frame 81 in a direction indicated by arrow C. The rotation of the first sheet metal 88A releases a held state of the shaft portion 83 of the heating roller 26B sandwiched by the first sheet metal 88A and the second sheet metal 88B, that is, results in a released state. As illustrated in FIG. 9, the first sheet metal 88A is separated to a position at which the first sheet metal 88A does not interfere with the shaft portion 83 of the heating roller 26B passing through the attaching and detaching path 81*a*. The shaft portion 83 of the heating roller 26B is taken out along the attaching and detaching path 81*a*, but the first sheet metal 88A and the second sheet metal 88B remain on the fixing frame 81. Accordingly, the shaft portion 83 of the heating roller 26B can be taken out along the attaching and detaching path 81*a* while the induction heating device 26C supported by the second sheet metal 88B is also left on the fixing frame 81.

As described above, in the present embodiment, the shaft portion 83 of the heating roller 26B is sandwiched between the two sheet metals 88A and 88B, and the second sheet metal 88B of these two sheet metals 88A and 88B supports the induction heating device 26C so that the induction heating device 26C is displaced together with the heating roller 26B. In addition, the first sheet metal 88A is separated to a position at which the first sheet metal 88A does not interfere with the shaft portion 83 of the heating roller 26B passing through the attaching and detaching path 81*a*, and the shaft portion 83 of the heating roller 26B is taken out along the attaching and detaching path 81*a*. Therefore, in the fixing device including the induction heating device 26C that is displaced together with the heating roller 26B in the direction orthogonal to the axial direction, the heating roller 26B can be installed in and removed from the fixing device in the direction orthogonal to the axial direction.

Figure 10:
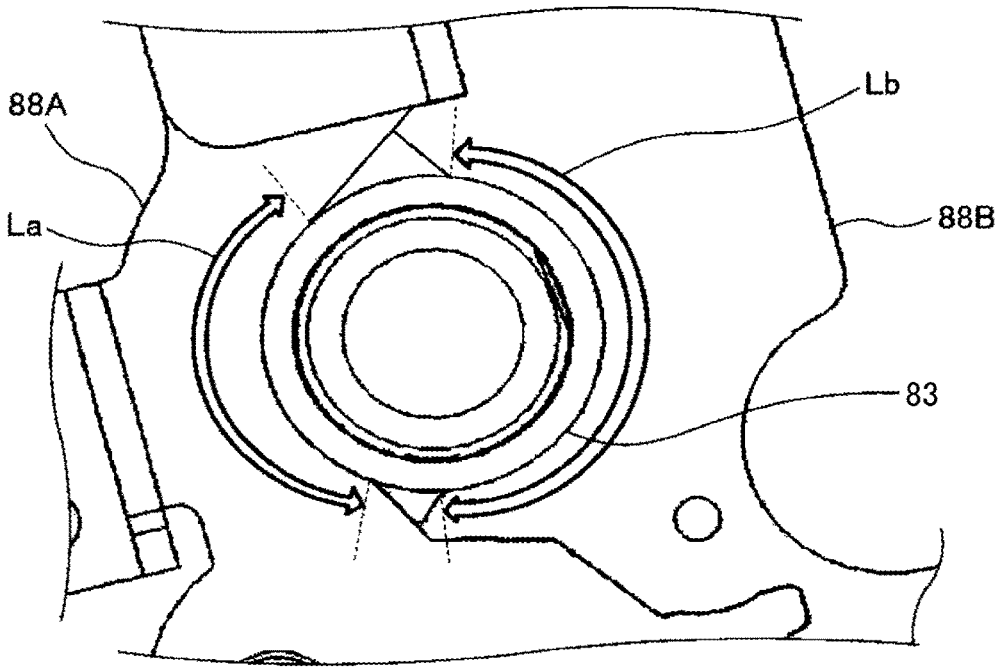
FIG. 10 is an explanatory view illustrating the positions of the first sheet metal and the second sheet metal that come into contact with the shaft portions of the heating roller held between the first sheet metal and the second sheet metal, according to an embodiment of the present disclosure.

In the present embodiment, the shaft portion 83 of the heating roller 26B is sandwiched by the two sheet metals 88A and 88B, the first sheet metal 88A contacts the shaft portion 83 in a contact portion La, and the second sheet metal 88B contacts the shaft portion 83 in a contact portion Lb. Particularly, as illustrated in FIG. 10, each of the contact portions La and Lb is an arc-shaped cutout portion having a central angle of 180° or less along an outer circumferential surface of the shaft portion 83. In the above-described configuration, when the shaft portion 83 of the heating roller 26B is sandwiched or released, the sheet metals 88A and 88B are not caught in the shaft portion 83.

As described above, in the present embodiment, the shaft portion 83 of the heating roller 26B is sandwiched between the two sheet metals 88A and 88B, and the second sheet metal 88B of these two sheet metals 88A and 88B supports the induction heating device 26C so that the induction heating device 26C is displaced together with the heating roller 26B. In addition, the first sheet metal 88A is separated to a position at which the first sheet metal 88A does not interfere with the shaft portion 83 of the heating roller 26B passing through the attaching and detaching path 81*a*, and the shaft portion 83 of the heating roller 26B is taken out along the attaching and detaching path 81*a*. Therefore, in the fixing device according to the present embodiment including the induction heating device 26C that is displaced together with the heating roller 26B in the direction orthogonal to the axial direction, the heating roller 26B can be installed in and removed from the fixing device in the direction orthogonal to the axial direction.

Figure 11:
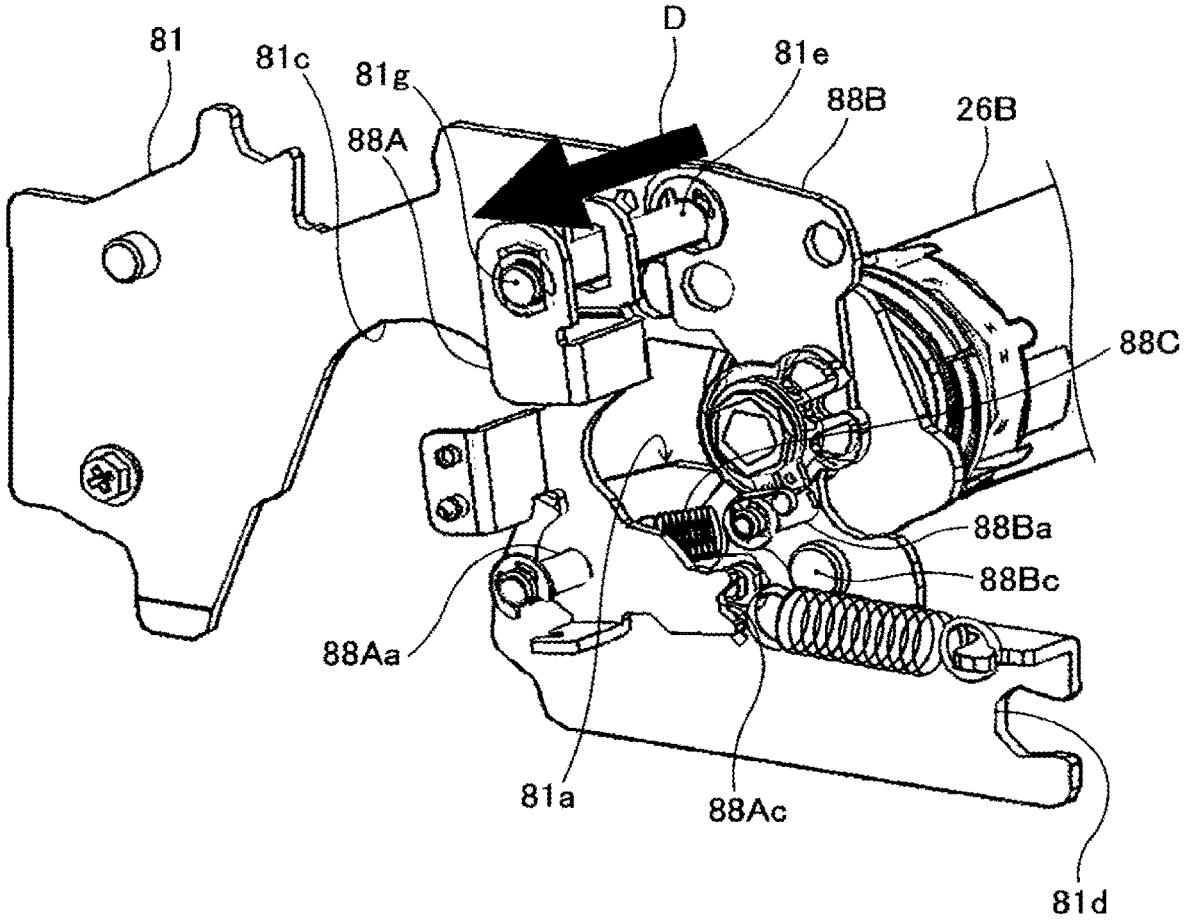
FIG. 11 is a perspective view of a supporter that supports the shaft portions of the heating roller in the fixing device, according to an embodiment of the present disclosure.

In addition, in the present embodiment, the first sheet metal 88A is configured to be movable in the axial direction of the rotation shaft 81*e* that is a direction indicated by arrow D in FIG. 11 in the released state. As a result, since the first sheet metal 88A can move axially outward of the shaft portion 83 of the heating roller 26B, the first sheet metal 88A does not interfere the shaft portion 83 of the heating roller 26B passing through the attaching and detaching path 81*a* even if the first sheet metal 88A is at any rotation position around the rotation shaft 81*e*. Preferably, as illustrated in FIG. 11, a stopper 81*g* is disposed at an axial end of the rotation shaft 81*e* to prevent the first sheet metal 88A from falling off the rotation shaft 81*e*.

When the first sheet metal 88A is configured to be movable in the axial direction of the rotation shaft 81*e* as in the present embodiment and the first sheet metal 88A is moved in the axial direction of the rotation shaft 81*e* under the held state, there is some concern that the shaft portion 83 of the heating roller 26B cannot appropriately be held by the second sheet metal 88B. For this reason, in the present embodiment, a limiter is disposed to restrict a movement of the first sheet metal 88A under the held state in the axial direction of the rotation shaft 81*e*. Specifically, as illustrated in FIG. 11, hooking a hook portion 88Ac of the first sheet metal 88A to a pin 88Bc provided on the second sheet metal 88B restricts the movement of the first sheet metal 88A in the axial direction of the rotation shaft 81*e*.

In the present embodiment, the configuration is described as an example in which the heating roller 26B which is a tension roller to support the fixing belt 26 that is an endless belt is attached and detached in the direction orthogonal to the axial direction. In addition to the roller to support the endless belt as described above, the present embodiment may be similarly applied to a rotator such as a roller that does not support the endless belt.

In the present embodiment, the fixing device provided in the image forming apparatus 1 is described as an example. The present embodiment may be applied to other rotation devices in the image forming apparatus 1 and rotation devices in apparatuses other than the image forming apparatus 1.

In the present embodiment, the fixing device provided in the image forming apparatus 1 is described as an example. The present embodiment may be applied to other belt devices in the image forming apparatus 1 and belt devices in apparatuses other than the image forming apparatus 1.

The configurations according to the above-descried embodiment are not limited thereto and can achieve the following aspects effectively.

First Aspect

A belt device such as the fixing device 25 according to the first aspect of the present disclosure includes an endless belt such as the fixing belt 26, a plurality of support rotators configured to support the endless belt such as the fixing roller 26A and the heating roller 26B, and a support such as the fixing frame 81 configured to support shaft portions of the plurality of support rotators such as the shaft portions 83 and 84, and the support such as the fixing frame 81 has an attaching and detaching path such as the attaching and detaching path 81*a* through which the shaft portions of the plurality of support rotators passes in a direction orthogonal to an axial direction of at least one of the plurality of support rotators when the shaft portions of the plurality of support rotators are detached from the support.

According to the first aspect of the present disclosure, the shaft portions of the plurality of support rotators supported by the supports can pass through the attaching and detaching path formed in the support and be removed from the support in the direction orthogonal to the axial direction. According to such a configuration, the shaft portions of the plurality of the support rotators and the endless belt wrapped around the plurality of support rotators can be detached together through the attaching and detaching path. Accordingly, it is no longer necessary to pull out some of the support rotators in the axial direction, and the endless belt and the plurality of supports can be detached easily.

In the present aspect, the shaft portions of the plurality of support rotators are removed in the direction orthogonal to the axial direction through the attaching and detaching path. Due to such a configuration, when one of the support rotators that is supported near the gateway of the attaching and detaching path is grasped and pulled out, shaft portions of the other support rotators can be pulled out together with the endless belt through the attaching and detaching path. If the shaft portions of the plurality of support rotators are detached in the direction orthogonal to the axial direction through separate attaching and detaching paths, the shaft portions are to be pulled out through different attaching and detaching paths separately. According to the first aspect of the present disclosure, when one of the shaft portions is pulled out through the attaching and detaching path, the shaft portions of the other support rotators and the endless belt can also be detached easily.

Second Aspect

In a second aspect of the present disclosure, at least one of the plurality of the support rotators such as the heating roller 26B in the belt device according to the first aspect of the present disclosure is a tensioner configured to apply tension to the endless belt. In addition, the support supports the shaft portion of the tensioner to be able to displace along the attaching and detaching path in the direction orthogonal to the axial direction.

In the configuration in which the shaft portions of the plurality of support rotators are removed in the direction orthogonal to the axial direction through the attaching and detaching path, at least one of support rotators can be displaced toward the other support rotator along the attaching and detaching path without being restricted by the support. Therefore, the at least one of support rotators can be used as the tensioner to apply the tension to the endless belt. Using the at least one of support rotators as the tensioner does not need setting another tensioner in addition to the plurality of the support rotators, which is advantageous in terms of simplification of the configuration, space saving, and the like.

Third Aspect

In a third aspect of the present disclosure, the belt device according to the second aspect of the present disclosure further includes a restraint such as the second fixing frame 86 that is detachably attached to the support and restrict a movement of the shaft portion such as the shaft portion 84 of the support rotator such as the fixing roller 26A other than the tensioner in the attaching and detaching path.

The configuration in which the shaft portions of the plurality of support rotators are removed in the direction orthogonal to the axial direction through the attaching and detaching path has a space from the support rotator other than the tensioner to the tensioner. Therefore, it is difficult to secure a sufficient area of the support that contacts and positions the shaft portion of the support rotator other than the tensioner so that the tension of the endless belt does not move the shaft portion of the support rotator other than the tensioner toward the tensioner.

In the third aspect of the present disclosure, the belt device includes a restraint that restricts the movement of the shaft portion of the support rotator other than the tensioner in the attaching and detaching path caused by the tension of the endless belt and positions the shaft portion of the support rotator other than the tensioner. Since such a restraint is detachably attached to the support, the restraint can be removed not to interfere the plurality of the support rotators when the plurality of support rotators pass through the attaching and detaching path in a direction orthogonal to the axial direction and are removed from the support.

Fourth Aspect

In a fourth aspect of the present disclosure, the belt device according to the third aspect of the present disclosure further includes an attachment such as the sub-face plate 87 that is fixed and positioned on the support. In addition, the restraint is fixed on the attachment, and the attachment is configured to be able to adjust a position of the restraint.

If the restraint is directly fixed to the support, for example, when the support rotator other than the tensioner is replaced, a dimensional error or the like may prevent properly positioning the shaft portion of the replaced support rotator. To properly position the shaft portion of the replaced support rotator, the support needs a long hole or the like to adjust a position of the restraint fixed on the support. The long hole may cause a problem such as reducing the strength of the support.

In the fourth aspect of the present disclosure, the restraint is fixed to the support via the attachment and attached to the attachment to be able to adjust a position of the restraint with respect to the attachment. The above-described configuration can suitably position the shaft portion of the support rotator even after the replacement of the support rotator without causing the problem such as reducing the strength of the support.

Fifth Aspect

In a fifth aspect of the present disclosure, the belt device according to the first aspect of the present disclosure further includes a frame such as the pressure frame 82 disposed opposite the gateway of the attaching and detaching path, and a rotation shaft such as the rotation shaft 82*a* to rotate the support with respect to the frame, and rotating the support on the rotation shaft switches between a gateway closed state in which the frame is opposite the gateway and a gateway opened state in which the frame is not opposite the gateway.

According to the fifth aspect of the present disclosure, even in a configuration in which the attachment is disposed opposite the gateway of the attaching and detaching path of the support, the endless belt and the plurality of support rotators can easily be removed.

Sixth Aspect

In a sixth aspect of the present disclosure, the belt device according to the fifth aspect of the present disclosure further includes a contact rotator such as the pressure roller 27 configured to contact a part of the endless belt supported on the support rotator nearest to the gateway of the attaching and detaching path, such as the fixing roller 26A. The contact rotator includes a shaft portion such as the shaft portion 85 supported by the frame. The frame is configured to be able to remove the shaft portion of the contact rotator in a direction orthogonal to an axial direction of the contact rotator.

Rotating the support on the rotation shaft and opening the gateway enables the contact rotator to remove from and install in the frame in the direction orthogonal to the axial direction of the contact rotator. The above-described configuration simplifies operations to replace the contact rotator because rotating the support on the rotation shaft and opening the gateway enables the contact rotator to remove from and install in the frame without removing the endless belt and the plurality of support rotators supported on the support from the support.

Seventh Aspect

In a seventh aspect of the present disclosure, the support in the belt device according to the sixth aspect of the present disclosure has a positioner such as the hollow 81*c* configured to contact and position a shaft portion of the support rotator nearest to the gateway at a position at which the support receives a force applied from the contact rotator to the support rotator nearest to the gateway.

According to the seventh aspect of the present disclosure, even if the support rotator nearest to the gateway receives a force from the contact rotator, the support can position the shaft portion of the support rotator nearest to the gateway.

Eighth Aspect

In an eighth aspect of the present disclosure, the shaft portion of the contact rotator in the belt device according to the sixth aspect of the present disclosure includes a rotation shaft pressed into a ball bearing.

The above-described configuration according to the eighth aspect of the present disclosure can lengthen the life of the contact rotator because there is no rubbing between the rotation shaft of the contact rotator and the ball bearing.

Ninth Aspect

In a ninth aspect of the present disclosure, the shaft portions of the plurality of support rotators in the belt device according to the first aspect of the present disclosure includes rotation shafts pressed into ball bearings.

The above-described configuration according to the ninth aspect of the present disclosure can lengthen the life of the support rotators because there is no rubbing between the rotation shafts of the support rotators and the ball bearings.

Tenth Aspect

In a tenth aspect of the present disclosure, an image forming apparatus includes the belt device according to the first aspect.

The tenth aspect of the present disclosure can provide the image forming apparatus including the belt device in which the work of removing the endless belt and the plurality of support rotators is easy.

Eleventh Aspect

A rotation device such as the fixing device 25 according to an eleventh aspect of the present disclosure includes a rotator such as the heating roller 26B including a shaft portion such as the shaft portion 83, and a supporter configured to support the shaft portion so that the shaft portion can be moved in a direction orthogonal to the axial direction of the rotator and that the shaft portion can be detached from and attached to the supporter. The supporter according to the eleventh aspect of the present disclosure includes a support such as the fixing frame 81 having an attaching and detaching path such as the attaching and detaching path 81*a* that enables attaching and detaching the shaft portion such as the shaft portion 83 in the direction orthogonal to the axial direction, a plurality of holders such as the first sheet metal 88A and the second sheet metal 88B configured to sandwich the shaft portion such as the shaft portion 83, and a changer such as the holding spring 88C configured to switch the plurality of holders between a held state and a released state. The support according to the eleventh aspect of the present disclosure supports the plurality of holders so that the shaft portion can move in the direction orthogonal to the axial direction along the attaching and detaching path in a held state. According to the eleventh aspect of the present disclosure, one of the plurality of holders is a gateway-side holder such as the first sheet metal 88A that is positioned closer to the gateway of the attaching and detaching path than the shaft portion and configured to be able to move to a position at which the gateway-side holder does not interfere the shaft portion that passes through the attaching and detaching path, and the other holder such as the second sheet metal 88B of the plurality of holders supports a part that is displaced together with the rotator and is disposed outside the rotator, such as the induction heating device 26C.

In the eleventh aspect of the present disclosure, the shaft portion of the rotator is sandwiched by the plurality of holders, and the support supports the plurality of holders to be able to move in a direction of the displacement of the rotator. Therefore, the rotator can be displaced in the direction orthogonal to the axial direction. In addition, the other holder of the plurality of holders supports the part that is displaced together with the rotator and is disposed outside the rotator. Therefore, the rotator and the part can be integrally displaced in the direction orthogonal to the axial direction.

The rotator and a part directly supported by the shaft portion of the rotator can also integrally displace. However, in this case, operations to remove the rotator remove the part that is displaced together with the rotator. The part is not needed to be removed. As a result, the workload is increased. When a part that is displaced together with the rotator, which is not necessarily detached, is to be left in the rotation device, such a part needs to be detached from the shaft of the rotator. This also increases the workload. According to the eleventh aspect of the present disclosure, the plurality of holders sandwiches the shaft portion of the rotator, and the other holder of the plurality of holders supports the part that is displaced together with the rotator. Therefore, without increasing the workload, the rotator can be removed, and the part can be left in the rotation device.

Additionally, in the eleventh aspect, the gateway-side holder of the plurality of the holders is configured to be able to move to the position at which the gateway-side holder does not interfere the shaft portion that passes through the attaching and detaching path in the support. Therefore, when the rotator is removed, moving the gateway-side holder enables the shaft portion of the rotator to move toward the gateway along the attaching and detaching path and enables the rotator to be removed.

As described above, in the eleventh aspect, the shaft portion of the rotator is configured to be sandwiched by the plurality of holders, and the other holder of the plurality of holders supports the part that is displaced together with the rotator, which enables the rotator to be easily removed and left the part in the rotation device. Additionally, in the eleventh aspect of the present disclosure, the gateway-side holder of the plurality of the holders is configured to be able to move to the position at which the gateway-side holder does not interfere the shaft portion that passes through the attaching and detaching path in the support, and the rotator can be removed from and installed in the support in the direction orthogonal to the axial direction. Therefore, even when the rotation device includes the part that is displaced together with the rotator in the direction orthogonal to the axial direction, the rotator can be easily installed in and removed from the rotation device in the direction orthogonal to the axial direction.

Twelfth Aspect

In a twelfth aspect of the present disclosure, the rotation device according to the eleventh aspect of the present disclosure includes an endless belt such as the fixing belt 26 and a support roller such as the fixing roller 26A including a shaft portion such as the shaft portion 84 and supporting the endless belt together with the rotator, the rotator is a tension roller such as the heating roller 26B configured to support the endless belt, and the support supports the shaft portion such as the shaft portion 84 on the attaching and detaching path at a position closer to the gateway than the rotator.

According to the twelfth aspect of the present disclosure, gripping the support roller around which the endless belt is wound and pulling out the shaft portion of the support roller along the attaching and detaching path can also pull out the shaft portion of the rotator along the attaching and detaching path, which facilitates the work of removing the endless belt, the support roller supporting the belt, and the rotator supporting the belt.

Thirteenth Aspect

In a thirteenth aspect of the present disclosure, the rotation device according to the eleventh or twelfth aspect of the present disclosure further includes a rotation shaft such as the rotation shaft 81*e*, and the support supports the plurality of holders so that the plurality of holders can rotate on the rotation shaft. Rotating the gateway-side holder around the rotation shaft to release the held state moves the gateway-side holder to a position at which the gateway-side holder does not interfere with the shaft portion passing through the attachment and detachment path.

According to the thirteenth aspect of the present disclosure, when the rotator is to be taken out along the attaching and detaching path, the gateway-side holder can be easily removed to the position at which the gateway-side holder does not interfere with the shaft portion that passes through the attaching and detaching path.

Fourteenth Aspect

In a fourteenth aspect of the present disclosure, the plurality of holders in the rotation device according to the thirteenth aspect of the present disclosure are at different positions in an axial direction of the rotation shaft and partially overlap each other when viewed in the axial direction.

According to the fourteenth aspect of the present disclosure, the shaft portion of the rotator can be sandwiched by the plurality of holders without requiring high accuracy.

Fifteenth Aspect

In a fifteenth aspect of the present disclosure, the plurality of holders in the rotation device according to the thirteenth or fourteenth aspect of the present disclosure have contact portions such as the contact portions La and Lb each of which is an arc-shaped cutout portion having a central angle of 180° or less along an outer circumferential surface of the shaft portion.

According to the fifteenth aspect of the present disclosure, when the shaft of the rotator is sandwiched or released, the plurality of holders is not caught in the shaft portion.

Sixteenth Aspect

In a sixteenth aspect of the present disclosure, the gateway-side holder in the rotation device according to any one of the thirteenth to fifteenth aspect of the present disclosure is configured to be movable in the axial direction of the rotation shaft in a released state.

According to the sixteenth aspect of the present disclosure, when a rotator is to be taken out along the attaching and detaching path, the gateway-side holder can easily be moved to the position at which the gateway-side holder does not interfere with the shaft portion that passes through the attaching and detaching path.

Seventeenth Aspect

In a seventeenth aspect of the present disclosure, the rotation device according to the sixteenth aspect of the present disclosure includes a stopper such as the stopper 81*g* at an axial end of the rotation shaft to prevent the gateway-side holder from falling off from the rotation shaft.

According to the seventeenth aspect of the present disclosure, it is possible to prevent the gateway-side holder from falling off from the rotation shaft.

Eighteenth Aspect

In an eighteenth aspect of the present disclosure, the rotation device according to the sixteenth or seventeenth aspect of the present disclosure further includes a limiter such as the pin 88Bc and the hook portion 88Ac configured to restrict movement of the gateway-side holder in the axial direction of the rotation shaft.

According to the eighteenth aspect of the present disclosure, the limiter can stop the movement of the gateway-side holder in the axial direction of the rotation shaft under a held state and avoid a situation in which the shaft portion of the rotator cannot be properly sandwiched between the gateway holder and the other holder.

Nineteenth Aspect

In a nineteenth aspect of the present disclosure, an image forming apparatus includes the rotation device according to any one of the eleventh to eighteenth aspect of the present disclosure.

Even when there is the part that is displaced together with the rotator displacing in the direction orthogonal to the axial direction of the rotator, the rotator can be removed from and installed in the direction orthogonal to the axial direction in the image forming apparatus according to the nineteenth aspect of the present disclosure.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A belt device, comprising:

an endless belt;

a plurality of support rotators to support the endless belt; and a support to support shaft portions of the plurality of support rotators, the support having an attaching and detaching path through which the shaft portions of the plurality of support rotators pass in a direction orthogonal to an axial direction of at least one of the plurality of support rotators when the shaft portions of the plurality of support rotators are detached from the support, the attaching and detaching path changing direction from a start of the path to an end of the path, a restraint detachably attached to the support to restrict a movement of the shaft portion of at least one of the support rotators other than the tensioner in the attaching and detaching path, and an attachment fixed and positioned on the support, wherein the restraint is fixed on the attachment, and the attachment is configured to adjust a position of the restraint.

2. The belt device according to claim 1, wherein at least one of the plurality of support rotators is a tensioner to apply tension to the endless belt.

3. The belt device according to claim 1, further comprising:

a frame disposed opposite a gateway of the attaching and detaching path; and a rotation shaft to rotate the support with respect to the frame, wherein the support is configured to rotate on the rotation shaft to switch between a gateway closed state in which the frame is opposite the gateway and a gateway opened state in which the frame is not opposite the gateway.

4. The belt device according to claim 3, further comprising:

a contact rotator to contact a part of the endless belt supported on a particular support rotator of the plurality of support rotators, the particular support rotator being nearest to the gateway of the attaching and detaching path, wherein the contact rotator includes a contact-rotator shaft portion supported by the frame, and wherein the frame has an attaching and detaching path through which the contact-rotator shaft portion of the contact rotator is detachable in a direction orthogonal to an axial direction of the contact rotator.

5. The belt device according to claim 4, wherein the support has a positioner to contact and position a shaft portion of the particular support rotator nearest to the gateway at a position at which the support receives a force applied from the contact rotator to the particular support rotator nearest to the gateway.

6. The belt device according to claim 4, wherein the contact rotator includes a rotation shaft, and the contact-rotator shaft portion of the contact rotator includes a ball bearing into which the rotation shaft is press-fitted.

7. The belt device according to claim 1, wherein the plurality of support rotators includes corresponding rotation shafts, and the shaft portions of the plurality of support rotators include bell bearings into which the corresponding rotation shafts are press-fitted.

8. An image forming apparatus comprising the belt device according to claim 1.

9. A belt device, comprising:

an endless belt;

a plurality of support rotators to support the endless belt;

a support to support shaft portions of the plurality of support rotators, the support having an attaching and detaching path through which the shaft portions of the plurality of support rotators pass in a direction orthogonal to an axial direction of at least one of the plurality of support rotators when the shaft portions of the plurality of support rotators are detached from the support;

a frame disposed opposite a gateway of the attaching and detaching path; and a rotation shaft to rotate the support with respect to the frame, wherein the support is configured to rotate on the rotation shaft to switch between gateway closed state in which the frame is opposite the gateway and a gateway opened state in which the frame is not opposite the gateway.

10. The belt device according to claim 9, further comprising:

a contact rotator to contact a part of the endless belt supported on a particular support rotator of the plurality of support rotators, the particular support rotator being nearest to the gateway of the attaching and detaching path, wherein the contact rotator includes a contact-rotator shaft portion supported by the frame, and wherein the frame has an attaching and detaching path through which the contact-rotator shaft portion of the contact rotator is detachable in a direction orthogonal to an axial direction of the contact rotator.

11. An image forming apparatus comprising the belt device according to claim 9.

* * * * *